United States Patent [19]

Lars-Jos

[11] 3,961,377

[45] June 8, 1976

[54] GLOVE AND METHOD FOR THE PRODUCTION OF SAID GLOVE

[76] Inventor: Pehr Lars-Jos, Mobyn, 78200 Malung, Sweden

[22] Filed: Oct. 15, 1974

[21] Appl. No.: 515,028

[30] Foreign Application Priority Data

Oct. 16, 1973 Sweden ..... 7314030

[52] U.S. Cl. ..... 2/169

[51] Int. Cl.² ..... A41D 19/02

[58] Field of Search..... 2/161 R, 169, 159, 161 A, 2/163

[56] References Cited

UNITED STATES PATENTS

| | | | |
|---|---|---|---|
| 1,377,338 | 5/1921 | Grinnell | 2/169 |
| 2,227,586 | 1/1941 | Johnson | 2/169 |
| 3,822,417 | 7/1974 | Lars-Jos | 2/169 |

*Primary Examiner*—G. V. Larkin

*Attorney, Agent, or Firm*—Haseltine, Lake & Waters

[57] ABSTRACT

A protective glove for protecting hands against cuts, burns, and injury to cold, etching, vibrations, friction and shock. The glove has a palmar hand portion and a palmar thumb portion. A dorsal hand rear portion and a dorsal thumb portion are connected to finger stall portions. Palmar and dorsal finger stall sections are in the form of a single integral piece of material in which the two dorsally extending and longitudinal edges are joined together along the mid-part of the dorsal side of the finger so as to avoid obstructing and irritating seams. The shape of the dorsal finger section of each finger stall portion conforms to the curvature of the dorsally joined edges which are extendable to provide sufficient space for the knuckle and finger joints upon a gripping movement of the hand. A protecting piece covers the palmar hand portion and at least the adjacent portions of the palmar side of the finger stalls.

12 Claims, 12 Drawing Figures

GLOVE AND METHOD FOR THE PRODUCTION OF SAID GLOVE

The present invention relates to a glove, especially a work glove, which effectively protects the hand.

A problem in connection with known gloves was that the gloves did not provide sufficient protection for the hands in an effective manner. Gloves of this kind have often been provided with leather of an extra thickness at the palm, which made said glove uncomfortable to work with and still provided very little protection against cuts, burns, damages due to cold, etching, vibrations, friction and thrusts. The fact that the finger portions often need an effective protection too, has made the previously known gloves unsuitable i. a. due to the rigidity of the reinforcement. Thus, the sensibility and adaptability of the glove is considerably reduced. Especially in cases where good sensibility towards the article to be handled, is essential, such a glove is not usable. In connection with cuts and stabs such a glove will often even be dangerous, since it fixes the point of attack, whereupon penetration of the glove and damage to the hand will occur. Due to the localization of the reinforcements and the general construction of the glove, the adaptability and mobility of the stalls are restrained by the pairs of joining seams between the stalls.

It is an object of the present invention to avoid said disadvantages and provide a glove which serves as a good protection for the hand and maintains the sensibility of the hand as well. Another advantage of the invention is that it provides a glove that can be adapted to the normal working of the hand.

The features of the present invention will appear from the claims as well as from the description hereinafter with reference to the drawings.

Figure 6:
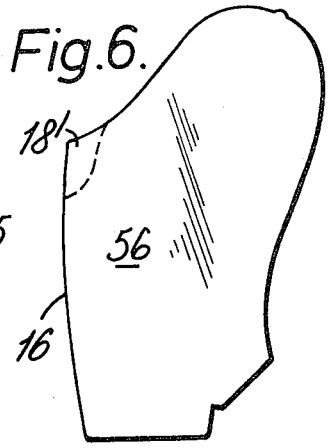
Figure 7:
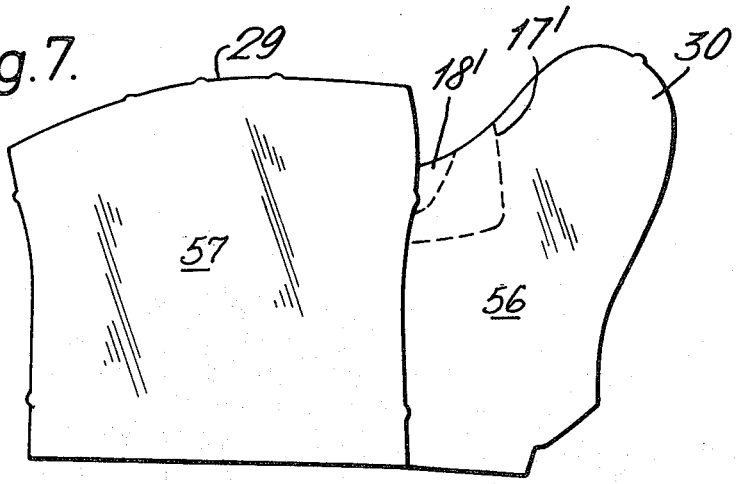
Figure 8:
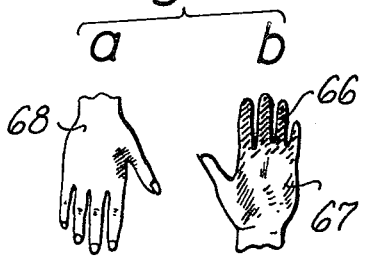
Figure 9:
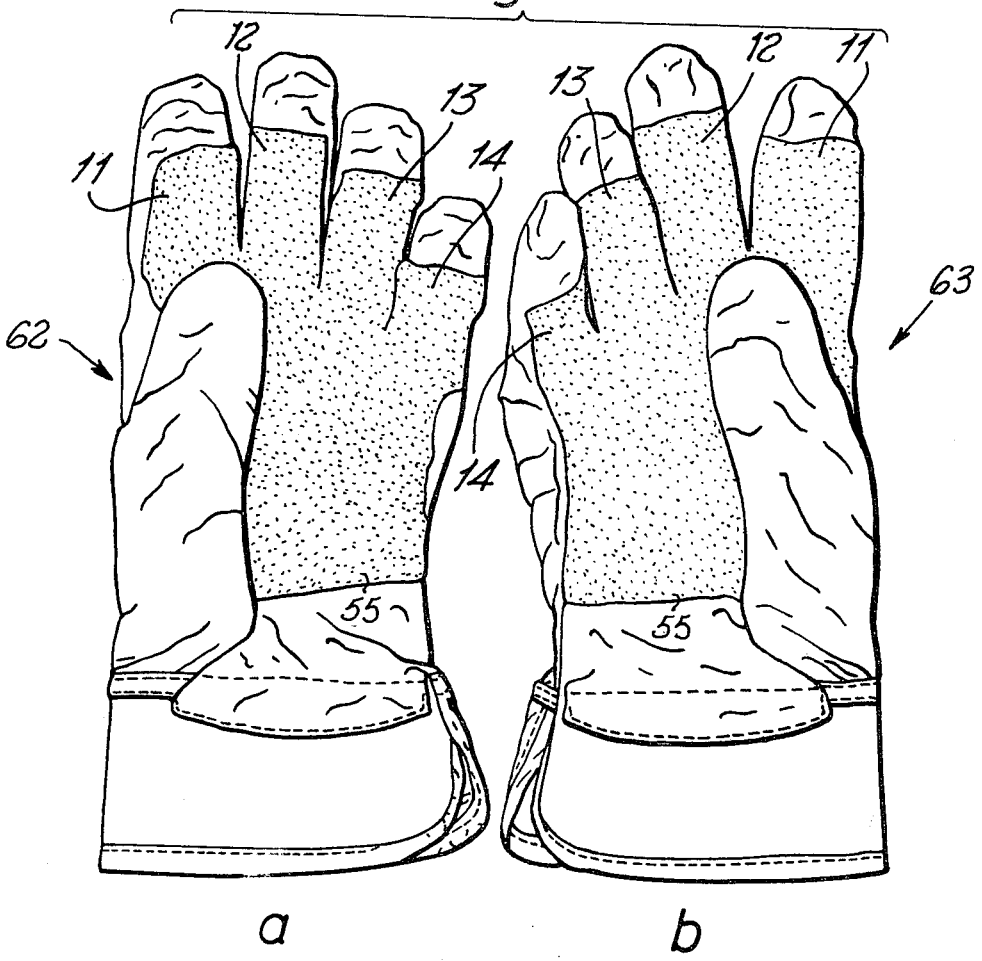
Figure 10:
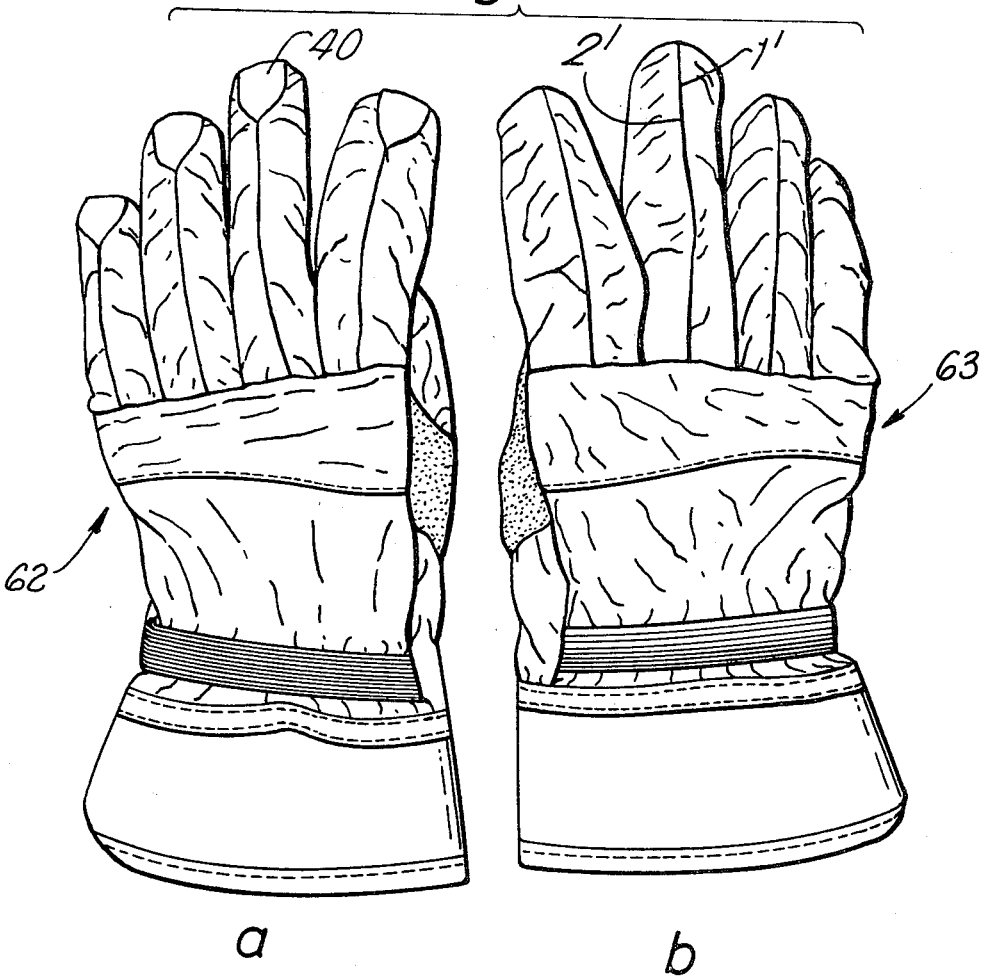
Figure 11:
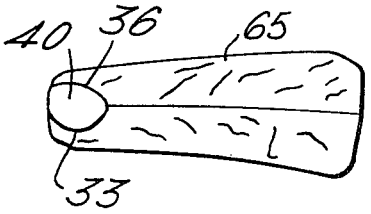
Figure 12:
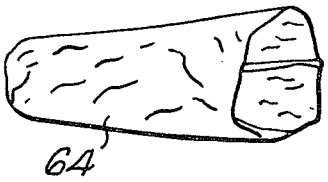

FIG. 1*a–d* is a plan view of the fore-finger section, the middle finger section, the ring finger section and the little finger section respectively, of the glove according to the invention. FIG. 2*a–d* is a plan view of the forefinger section, the middle finger section, the ring finger section and the little finger section respectively of another embodiment of the glove according to the present invention. FIG. 3 shows the palm portion of the glove, FIG. 4 the reinforcement piece of the glove and FIG. 5 the back-of-the-hand portion of the glove. FIG. 6 shows the thumb top portion of the glove according to the invention. FIG. 7 shows the two back-of-the-hand portions according to FIGS. 5 and 6 joined together. FIG. 8 by shading indicates the most usual places of damages to the hand. FIG. 9 shows the glove according to the embodiments shown in FIGS. 1 and 2, seen towards the palm portion, and FIG. 10 shows the glove according to said embodiments, seen towards the back-of-the-hand portion. FIGS. 11 and 12 show an assembled glove-finger according to FIG. 2.

The composition of the glove will now be described more closely with reference to FIG. 1

Figure 3:
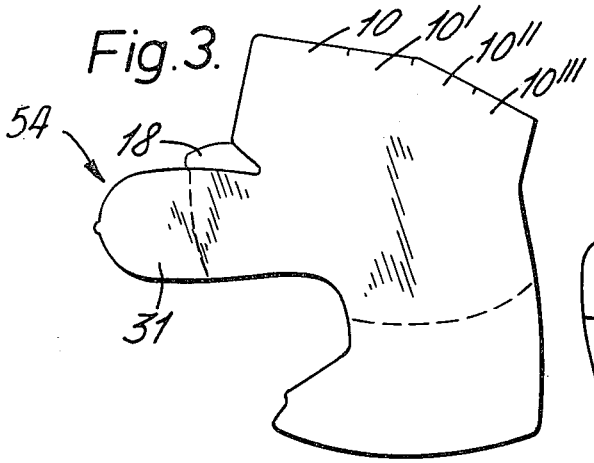
Figure 4:
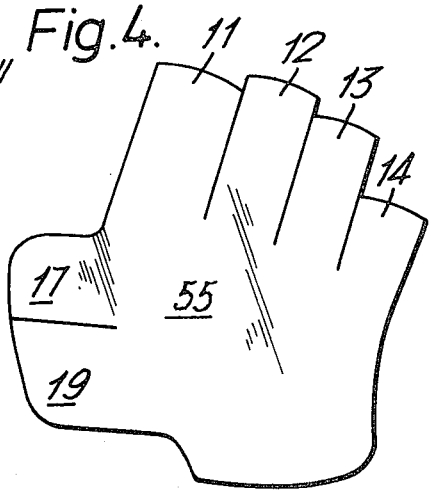

Each finger 64, 65 has one seam in the longitudinal direction of the finger. The assemblage of one finger stall, e.g. the fore-finger stall 50, as shown in FIG. 1a, is achieved by joining the edges 1 and 2 as well as 3, 5 and 4. The stalls of the middle finger 51 of FIG. 1b, the ring finger 52 of FIG. 1c and the little finger 53 of FIG. 1d respectively are joined together in the same manner by stitching together the edges 1′ and 2′; 3′, 5′ and 4′; 1″ and 2″; and 3″, 5″, and 4″; 1‴, and 2‴; 3‴, 5‴, and 4‴ respectively. The special structure of the finger stalls of the glove permits adaption of the bending of the stalls to the flexing of the fingers of the hand. This is of considerable importance to provide the glove with a correctly adapted shape. By variation of the curvature of the edges 1, 2; 1′, 2′, 1″, 2″; 1‴, 2‴ a glove can be provided with finger sections adapted to any normal working position of the hand. This is very important so that the hand and especially the fingers may have maximum sensibility in their normal working position. When a glove is given a correctly adapted shape, its adaptability is enhanced as well as the sensibility of the fingers, and the hazard of certain kinds of damages is reduced. Then the fore-finger stall (FIG. 1a) is joined to the middle finger stall (FIG. 1*b*) along the edges 6, 6′, the middle finger stall (FIG. 1*b*) is joined to the ring finger stall (FIG. 1*c*) along the edges 7, 7′, and the ring finger stall (FIG. 1*c*) is joined to the little finger stall (FIG. 1d) along the edges 8, 8′. Said four finger stalls are then joined to the palm portion 54, as shown in FIG. 3, where the edges 9, 10; 9′, 10′; 9″, 10″: and 9‴, 10‴ respectively are assembled. The protecting piece 55 as shown in FIG. 4 is then stitched onto the palm portion as shown in FIG. 3, and onto the fingers, as shown in FIG. 1. However, it is essential that the protecting piece portion is only stitched along its edges, so that it might slide relative to the subjacent glove portion. This condition is especially important, e.g. in cases of cuts or stabs towards the glove. The sliding connection between the protecting piece portion and the subjacent glove portion will then cause the point of attack to slide, causing a change of the angle of attack, so that any damage of the subjacent glove portion and of the hand itself may often be avoided. The protecting piece 55 is suitably made of a heat- and cold-resistive material, being light, flexible, suitably woven and having a terry cloth appearance. Obviously, the finger protecting portions 11, 12, 13, 14 and 19 respectively can be arranged so as to cover the inside of the fingers completely. This will in reality depend on the work for which the glove is intended. The portion 17 protects the groove between the thumb and the fore-finger stalls, where experience has proved the occurence of many and dangerous damages. To improve the adaptability and sensibility at this groove, seams should suitably be avoided at this location. According to the invention this problem is solved by a "groove" portion 18 which is placed across said groove. A corresponding portion 18′ is then cut out from the thumb top portion 56, as shown in FIG. 6.

The thumb top portion 56 (FIG. 6) and the back-of-the-hand portion 57 (FIG. 5) are then joined along the edges 15, 16 so that the assembled portion looks as shown in FIG. 7. Reference numeral 17′ indicates the position of the protecting piece 17 on the assembled portion. It is evident that the piece 17 may have any suitable shape.

Figure 5:
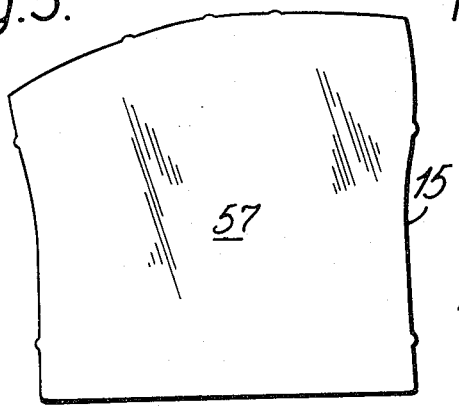

The finger stalls 50-53 (FIG. 1a-1d) are then joined to the back-of-the-hand portion along the edge 29, as shown in FIGS. 5 and 7, and the finger stall edges 20–29 will then run from right towards left along the edge 29, as shown in FIG. 7.

By needle-work, the edge 30 of the thumb top portion is then joined with the edge 31 of the back-of-the-hand portion. During this assemblage any portions of the protecting piece (FIG. 4) not yet joined to the glove, will be joined to it.

Figure 1:
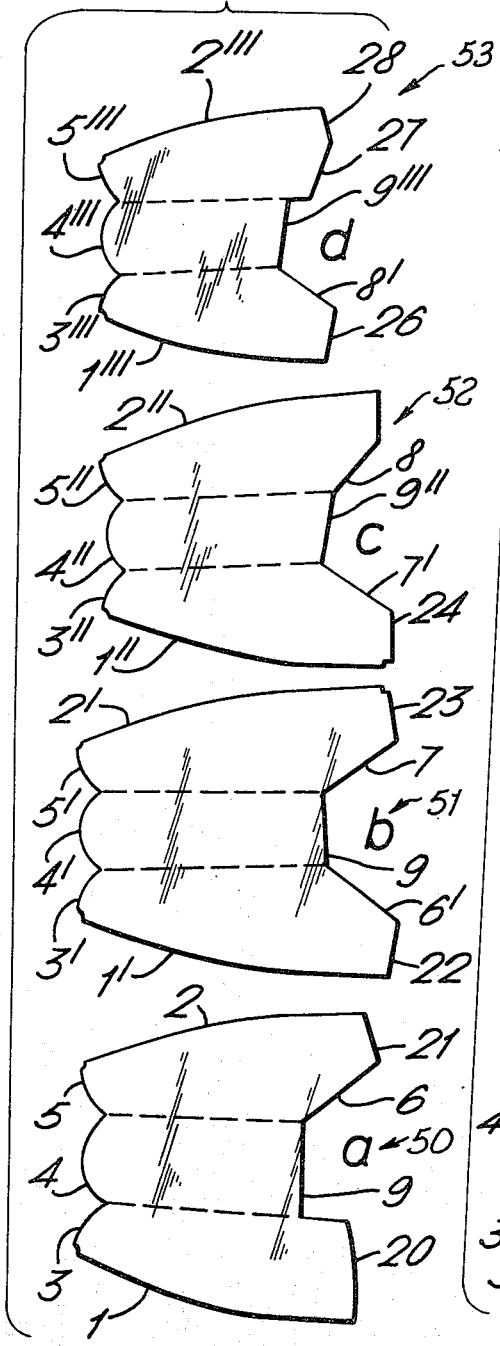
Figure 2:
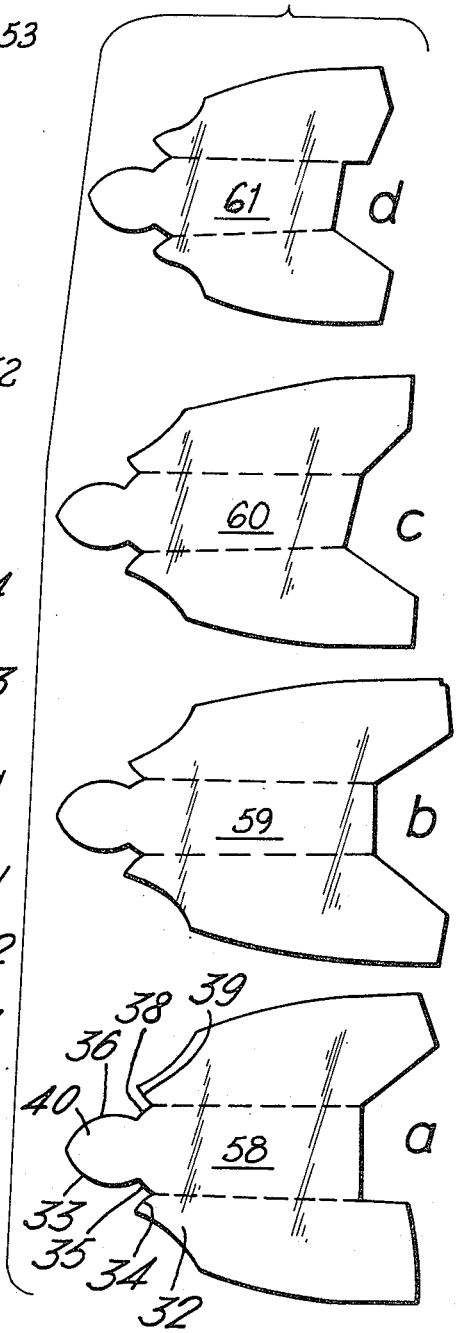

To achieve further adaptability and sensibility in the finger stall tips, the finger sections 58-61 may be shaped as shown in FIGS. 2–*d*, 11 and 12. The assemblage of the finger stalls is carried out as described in connection with FIG. 1, with the difference that the shape of the finger stall tips is different from that shown in FIG. 1. Thus, the edge 32 is joined to the edge 33, the edge 34 to the edge 35, the edge 36 to the edge 37, and the edge 38 to the edge 39, as shown in FIG. 2a. The other connections between the finger sections are thus identical with those mentioned with reference to FIG. 1. By thus shaping the finger stall tips of the glove without seams at the finger stall tip itself, and forming a finger nail resembling flap 40 which is provided above the hand-finger nail, the glove will yield great adaptability and sensibility for the finger tips of the hand.

Thus FIGS. 1 and 2 show the finger sections with a dorsal division and an open finger tip section as well as an opening already adapted to the metacarpus. The basic principle in cutting the finger sections to size will essentially control the assemblage. By the above mentioned cutting of the finger sections and the assemblage thus controlled, a finger portion is achieved, which permits the use of extra joints for special protection pieces without any reduction or elimination of the coordinated and individual mobility of the fingers.

As a special form of the above described basic principle for the finger sections according to the present invention a cut-out of finger sections has been achieved, comprising a closed finger tip portion by placing the opening periferically and above the root of the fingernail.

For the utilization of the above mentioned separate finger sections a palmar wrist and palm portion has been constructed so as to meet the finger sections along the palm and finger angle arc either in contact therewith or at some distance therefrom. Further, the distal palm portion may be individualized as to its arcuate shape. This cut also determines the assemblage. The thumb portion and the back-of-the-hand portion may be cut in one piece and joined to the other portions. The shape of the final glove 62, 63 is shown in FIGS. 9 and 10. FIG. 9*a* and *b* show the palm portion of the glove, where the protecting piece 55 as indicated in FIG. 4, is clearly seen.

The glove 62 in FIGS. 9 and 10 is shown with the finger stalls of FIG. 2.

The glove b 63 in FIGS. 9 and 10 is shown with the finger stalls of FIG. 1.

For the sake of clarity and to stress the importance of the present invention, those portions 66 of the hand 67, 68 where damages usually occur, are indicated by shading in FIGS. 8a and 8b.

In the previously known gloves for protection of the hand it was in fact never possible to achieve an effective protection as well as good adaptability and sensibility for the hand.

The general structure and the angular adaption of the glove fingers to the metacarpus are in principle based on the Swedish Pat. No. 357,662.

The cut as well as the assemblage are not only adapted to the requirements of the hand itself, but also to the requirement for protection without any influence worth mentioning on the grip and movement of the glove.

It will be evident that the glove within the scope of the invention can be provided with cuffs, the back-of-the-hand portion can be manufactured in several sections, and the most suitable materials available whenever gloves according to the invention are produced, will be chosen for the production of the gloves.

Also, within the scope of the invention, it is possible to use a detachable protective piece, which is e. g. secured by adhering, knitting or crochet-work to the protective piece of FIG. 4, which has already been secured to the glove. By such a modification the wearing piece of the glove is easily replaceable if necessary.

Even though the glove is hereinbefore shown and described in connection with a protective piece as shown in FIG. 4, it is obviously possible to use the glove without any such protecting piece in case there is no need for it.

The dorsal hand length when the hand is flexed in millimeters, is equal to 0,970 times the dorsal hand length in millimeters when the hand is stretched plus 16,80 mm. The palmar glove length when the hand is flexed in millimeters, is equal to 0,786 times the palmar hand length in millimeters when the hand is stretched plus 14,02 mm. These data are correct for any hand. Thus the mathematical dimensions of the glove are precisely determined.

I claim:

1. A protective glove, including a palmar hand portion having a palmar thumb portion, a dorsal hand rear portion and a dorsal thumb portion, finger stall portions connection to said palmar hand portion and said dorsal hand rear portion, respective palmar and dorsal finger stall sections of each finger stall portion comprised of one single piece of material, each said piece having two dorsally extending, opposite and longitudinal edges joined together along the mid-part of the dorsal finger stall portion, the shape of said dorsal finger stall section of each finger stall portion conforming to the curvature of the dorsally joined edges, and a protecting piece covering the palmar hand portion and at least the adjacent parts of the palmar side of each finger stall portion said protecting piece being connected to said palmar side.

2. A protective glove as defined in claim 1, wherein said finger stall portions comprise fore-finger, middle finger, ring finger and little finger stall portions, each of said stall portions having a finger stall tip portion including a flap integral therewith and folded as part of the dorsal side of the respective finger stall portion, said flap having a seam of the finger stall tip portion arranged peripherically and substantially above the root of a fingernail of a finger inserted inside the respective finger stall portion.

3. A protective glove as defined in claim 1, wherein said protecting piece has edges at least partly secured in joining seams of said glove, said protecting piece being slidable relative to subjacent glove portions.

4. A protective glove as defined in claim 1, wherein said protecting piece comprises a heat and cold resistant, elastic, woven material.

5. A protective glove as defined in claim 4, wherein said material is a terry cloth type material.

6. A protective glove as claimed in claim 4, wherein said protecting piece has a detachable wearing piece.

7. A protective glove, including a palmar hand portion having a palmar thumb portion, a dorsal hand rear portion and a dorsal thumb portion, finger stall portions connected to said palmar hand portion and said dorsal hand rear portion, respective palmar and dorsal finger stall sections of each finger stall portion comprised of one single piece of material, each said piece having two dorsally extending, longitudinal edges joined together along the longitudinal mid-part of the dorsal finger stall section, the shape of said dorsal finger stall section of each finger stall portion conforming to the curvature of the dorsally joined edges, said palmar hand portion having a groove between the thumb and the fore-finger and having a flap covering said groove, said flap protecting said groove against damage, and a protecting piece covering the palmar hand portion and at least the adjacent parts of the palmar side of each finger stall portion said protecting piece being connected to said palmar side.

8. A protective glove as defined in claim 7, wherein said finger stall portions comprise fore-finger, middle finger, ring finger and little finger stall portions, each of said stall portions having a finger stall tip portion including a flap integral therewith and folded as part of the dorsal side of the respective finger stall portion, said flap having a seam of the finger stall tip portion arranged peripherically and substantially above the root of a fingernail of a finger inserted inside the respective finger stall portion.

9. A protective glove as defined in claim 7, wherein said protecting piece has edges at least partly secured in joining seams of said glove, said protecting piece being slidable relative to subjacent glove portions.

10. A protective glove as defined in claim 7, wherein said protecting piece comprises a heat and cold resistant, elastic woven material.

11. A protective glove as defined in claim 10, wherein said material is a terry cloth type material.

12. A protective glove as claimed in claim 10, wherein said protecting piece has a detachable wearing piece.

* * * * *